US011117188B2

(12) United States Patent
O'Sullivan et al.

(10) Patent No.: US 11,117,188 B2
(45) Date of Patent: Sep. 14, 2021

(54) CHROMIUM METAL POWDER

(71) Applicant: PLANSEE SE, Reutte (AT)

(72) Inventors: Michael O'Sullivan, Ehenbichl (AT); Lorenz Sigl, Lechaschau (AT)

(73) Assignee: Plansee SE, Reutte (AT)

( * ) Notice: Subject to any disclaimer, the term of this patent is extended or adjusted under 35 U.S.C. 154(b) by 1225 days.

(21) Appl. No.: 14/915,785

(22) PCT Filed: Aug. 19, 2014

(86) PCT No.: PCT/AT2014/000160
§ 371 (c)(1),
(2) Date: Mar. 1, 2016

(87) PCT Pub. No.: WO2015/027256
PCT Pub. Date: Mar. 5, 2015

(65) Prior Publication Data

US 2016/0199910 A1 Jul. 14, 2016

(30) Foreign Application Priority Data

Sep. 2, 2013 (AT) ..... GM 283/2013

(51) Int. Cl.

| | |
|---|---|
| ***B22F 1/00*** | (2006.01) |
| ***B22F 9/22*** | (2006.01) |
| ***A61H 33/06*** | (2006.01) |
| ***C22C 27/06*** | (2006.01) |

(52) U.S. Cl.
CPC ..... *B22F 1/0003* (2013.01); *A61H 33/065* (2013.01); *B22F 9/22* (2013.01); *C22C 27/06* (2013.01); *B22F 2201/013* (2013.01); *B22F 2202/00* (2013.01); *B22F 2301/20* (2013.01)

(58) Field of Classification Search
CPC ..... B22F 1/0003
See application file for complete search history.

(56) References Cited

U.S. PATENT DOCUMENTS

| | | | |
|---|---|---|---|
| 4,148,628 | A | 4/1979 | Fukunishi et al. |
| 5,403,543 | A | 4/1995 | Okutomi et al. |
| 6,106,765 | A | 8/2000 | Lee et al. |
| 6,764,557 | B2 | 7/2004 | Saenger et al. |
| 8,535,605 | B2 | 9/2013 | Orth et al. |
| 9,279,617 | B2 | 3/2016 | Baudis |
| 2009/0068055 | A1 | 3/2009 | Sreedhara et al. |

FOREIGN PATENT DOCUMENTS

| | | | |
|---|---|---|---|
| CN | 1031400 | A | 3/1989 |
| CN | 1068597 | A | 2/1993 |
| CN | 101808768 | A | 8/2010 |
| CN | 101925427 | A | 12/2010 |
| DE | 2807034 | A1 | 8/1978 |
| EP | 0452079 | A1 | 10/1991 |
| EP | 1102651 | A1 | 5/2001 |
| GB | 512502 | A | 9/1939 |
| GB | 2255349 | A | 11/1992 |
| JP | S53102813 | A | 9/1978 |
| JP | S5413408 | A | 1/1979 |
| JP | S63199832 | A | 8/1988 |
| JP | H04318134 | A | 11/1992 |
| JP | H0681052 | A | 3/1994 |
| JP | H07216474 | A | 8/1995 |
| JP | 3934686 | B2 | 6/2007 |
| SU | 142431 | A1 | 11/1961 |
| SU | 1061938 | A1 | 12/1983 |
| WO | 0153022 | A1 | 7/2001 |

OTHER PUBLICATIONS

ASTM B312-09 StandardTest Method for Green Strength of Specimens Compacted from Metal Powders. 2009.*

German, Randall M.: "Powder Metallurgy Science, 2nd ed.", 1994, MPIF, pp. 63 and 183-184.

Sully, Arthur Henry: "Chromium", Metallurgy of the Rarer Metals, Butterworths Scientific Publications, 1954, pp. 16-63.

Loubiere, S. et al: "Powders of Chromium and Chromium Carbides of Different Morphology and Narrow Size Distribution", Materials Research Bulletin, Elsevier, Kidlington, GB, vol. 33, No. 6, 1, 1998, pp. 935-944, XP004145436, ISSN: 0025-5408, D01: 10.1016/S0025-5408(98)00062-2.

* cited by examiner

*Primary Examiner* — Christopher S Kessler
(74) *Attorney, Agent, or Firm* — Laurence A. Greenberg; Werner H. Sterner; Ralph E. Locher

(57) ABSTRACT

A metal powder has a chromium content of at least 90 Ma %, a nanohardness according to EN ISO 14577-1 of ≤4 GPa and/or a green strength measured according to ASTM B312-09 of at least 7 MPa at a compression pressure of 550 MPa.

18 Claims, 5 Drawing Sheets

CHROMIUM METAL POWDER

BACKGROUND OF THE INVENTION

Field of the Invention

The present invention relates to a metal powder having a chromium content of at least 90 Ma % and a method for the production thereof.

The large-scale industrial production of chromium metal powder from chromium oxides is currently performed only by aluminothermic (powder morphology, see FIG. 1) and electrolytic (powder morphology, see FIG. 2) methods. Powders thus produced have poor compression and sintering behaviour, however. In addition, as a result of the use of Cr(VI) compounds, electrolytic methods are environmentally harmful. Increasingly stricter environmental regulations have the result that this process is hardly still economically and environmentally justifiable.

In addition to the already mentioned methods, the reduction of chromium oxides using hydrogen and/or carbon (see, for example: "Metallurgy of the Rarer Metals—Chromium"; Arthur Henry Sully; Butterworths Scientific Publications (1954), GB 512,502, JP 54013408 A, JP 07216474 A, JP 3934686 B2, and JP 06081052 A) is also described.

BRIEF SUMMARY OF THE INVENTION

However, it was not possible up to this point to produce chromium metal powder using the known methods, which is suitable for demanding, powder-metallurgy processes, for example, the production of thin-walled components or components having more complex shapes, in particular since the green strength of known powders is excessively low and the hardness thereof is excessively high.

The present invention therefore has the object of providing metal powders having a chromium content of at least 90 Ma %, which may be processed well by powder metallurgy, in particular by compression and sintering. In particular, a metal powder is to be provided, using which complexly-shaped and/or thin-walled components are producible in a simple manner by powder metallurgy. The metal powder is furthermore to be producible in a high metallic degree of purity, in particular a metallic degree of purity comparable to or better than metal powder which is obtained electrolytically. Furthermore, it is the object of the invention to provide a method which is suitable for large-scale industrial, cost-effective, and environmentally-friendly production of such metal powders.

The object is achieved by metal powder having a chromium content of at least 90 Ma %, which is characterized by a nanohardness $_{HIT\ 0.005/5/1/5}$ measured according to EN ISO 14577-1 (edition 2002—Berkovich penetration body and analysis method according to Oliver and Pharr) of ≤4 GPa. The hardness value relates in this case to a metal powder, which is preferably not subjected to further posttreatment, for example, annealing. The nanohardness $_{HIT\ 0.005/5/1/5}$ is preferably ≤3.7 GPa, particularly preferably ≤3.4 GPa. In the case of very high demands, for example, for very thin-walled components, a nanohardness $_{HIT\ 0.005/5/1/5}$ of 3.1 GPa has proven itself. In the case of very pure chromium powder, a nanohardness $_{HIT\ 0.005/5/1/5}$ of approximately 1.4 GPa may be implemented. The nanohardness is determined in this case in the pure chromium phase. If no pure chromium phase is present, the nanohardness is determined in the phase richest in chromium (phase having the highest chromium content). The metal powder according to the invention therefore has a significantly lower nanohardness in comparison to the nanohardnesses of metal powders according to the prior art. Since the powder according to the invention can be produced without a downstream grinding process, the specified nanohardness can also be achieved in the case of very fine-grained powder having a surface area according to BET of preferably ≥0.05 $m^2/g$. The specifications on the surface area according to BET in the scope of this application relate to a BET measurement according to the standard (ISO 9277:1995, measurement range: 0.01-300 $m^2/g$; device: Gemini II 2370, heating temperature: 130° C., heating time: 2 hours; adsorptive: nitrogen, volumetric analysis via five-point determination).

The object is furthermore achieved by a metal powder having a chromium content of at least 90 Ma %, which is characterized by a green strength measured according to ASTM B 312-09 at a compression pressure of 550 MPa of at least 7 MPa, preferably at least 10 MPa, especially preferably at least 15 MPa, in particular especially preferably at least 20 MPa. In the case of very pure, coarse-grained chromium powder having comparatively high BET surface area, at a compression pressure of 550 MPa, metal powder having a green strength of up to approximately 50 MPa may be implemented. ASTM B 312-09 leaves open in this case whether a wax is used as a compression additive. According to the invention, a wax was used as a compression additive, specifically 0.6 Ma % of an amide wax, namely LICOWAX® Micropowder PM (supplier Clariant, product number 107075, CAS-No. 00110-30-5).

Furthermore, the green strength preferably has the following values: at least 8 MPa, preferably at least 13 MPa, at a compression pressure of 450 MPa; at least 6 MPa, preferably at least 11 MPa, at a compression pressure of 300 MPa; at least 4 MPa, preferably at least 6 MPa, at a compression pressure of 250 MPa, and at least 2 MPa, preferably at least 2.5 MPa, at a compression pressure of 150 MPa. Green strengths at compression pressures of 450, 300, and 250 MPa of 18.5, 13.0, and 7.5 MPa and greater can be achieved.

The metal powder according to the invention may be processed in a simple manner by powder metallurgy, for example, by compression and sintering. In particular, the metal powder according to the invention allows the simple and cost-effective powder-metallurgy production of components having thin-walled regions, complex shape, or comparatively unfavourable compression ratio.

The properties with respect to nanohardness and green strength can be achieved if the chromium content is at least 90 Ma % and therefore the content of other materials of 10 Ma % is not exceeded. The other materials are advantageously provided in this case separately from the chromium phase. Furthermore, the other material can be attached in metallic or nonmetallic form, preferably via a diffusion bond. Such powders are referred to as composite powders. Proportions (advantageously <5 Ma %) of the other material can also be dissolved in the chromium and form a chromium mixed crystal. Such powders are referred to as alloyed powders. The metal powder then comprises a pure chromium phase and/or a chromium mixed crystal phase.

For example, $La_2O_3$ (up to at most 5 Ma %) or copper (up to at most 10 Ma %) can be mentioned as alloy components, wherein, in the case of $La_2O_3$, $La(OH)_3$ and, in the case of copper, CuO is mixed with $Cr_2O_3$ and supplied to the reduction. Of course, however, other metals or nonmetals are also possible.

The metal powder preferably has both a green strength at a compression pressure of 550 MPa of at least 7 MPa, preferably at least 10 MPa, especially preferably at least 15 MPa, in particular especially preferably at least 20 MPa, and also a nanohardness $_{HIT\ 0.005/5/1/5}$ of ≤4 GPa, preferably ≤3.7 GPa, especially preferably ≤3.4 GPa, in particular especially preferably ≤3.1 GPa.

Furthermore, the metal powder according to the invention preferably has a sponge-like particle shape/morphology (classification of the particle shape/morphology see Powder Metallurgy Science; Randall M. German; MPIF; Princeton, 1994, second edition, page 63). This has a favourable effect on the green strength.

The combination of sponge-like particle shape/morphology and low hardness permits comparatively high compression densities, but above all permits a very high green strength at given density.

In a preferred embodiment variant, it is provided that the metal powder has a surface area according to BET without surface-enlarging operation of 0.05 $m^2/g$. The surface area according to BET is preferably 0.07 $m^2/g$. Surface areas according to BET of 0.25 $m^2/g$ and greater can be achieved. Without surface-enlarging operation can also mean in this context "as produced" and indicates for a person skilled in the art that the metal powder was obtained directly from the method and in particular was no longer subjected to a grinding operation. Such a grinding operation is recognizable on the morphology of the metal powder, since smooth fracture surfaces form during the grinding operation, which are not to be found in unground powder. Only a deagglomeration is preferably provided according to the invention.

In one embodiment variant, it is provided that the metal powder according to the invention has a metallic purity, i.e., a content of chromium in relation to other metals, of 99.0 Ma %, preferably 99.5 Ma %, especially preferably 99.9 Ma %, in particular preferably 99.99 Ma %. Metallic purity is to be understood in this case as the purity of the metal powder without consideration of nonmetallic components, for example, oxygen, carbon, nitrogen, and hydrogen.

The oxygen content of metal powder according to the invention is preferably not greater than 1500 μg/g chromium, particularly preferably not greater than 1000 μg/g chromium. In an especially preferred embodiment variant, the oxygen content is not greater than 500 μg/g chromium. The achievable carbon content can be set very low and is preferably not greater than 150 μg/g chromium, particularly preferably not greater than 100 μg/g chromium. In an especially preferred embodiment variant, the carbon content is not greater than 50 μg/g chromium.

In one embodiment variant, it can be provided that the metal powder is granulated. The granulation can be performed by typical methods, preferably by spraying granulation or agglomeration (see also in this regard Powder Metallurgy Science; Randall M. German; MPIF; Princeton, 1994, second edition, pages 183 to 184). Granulate is to be understood in this case as the joining together of individual powder particles, which are connected to one another, for example, by means of a binder or by sinter neck formation.

In one embodiment variant, the metal powder has a bulk density of 2.0 $g/cm^3$. The bulk density is preferably 0.1 to 2 $g/cm^3$, especially preferably 0.5 to 1.5 $g/cm^3$. Since a comparatively high bulk density is achieved for the achievable particle size or BET surface area (preferably of ≥0.05 $m^2/g$), the powder has good filling behaviour during the compression operation.

Furthermore, the metal powder preferably has a compression density ≥80% of the theoretical density at 550 MPa compression pressure. It is therefore possible to manufacture components close to the final contour without a high sintering loss.

The metal powder according to the invention may be produced by reduction of at least one compound of the group consisting of chromium oxide and chromium hydroxide, optionally with an admixed solid carbon source, under at least temporary action of hydrogen and hydrocarbon. Preferably, Cr(III) compounds in powder form come into consideration as a chromium oxide or chromium hydroxide, for example, $Cr_2O_3$, CrOOH, $Cr(OH)_3$, or mixtures of chromium oxides and chromium hydroxides. The preferred chromium source is $Cr_2O_3$. For a high degree of purity in the final product, it is preferably provided that the $Cr_2O_3$ used has at least pigment quality.

The compound of the group consisting of chromium oxide and chromium hydroxide, optionally having an admixed solid carbon source, is preferably heated to a temperature $T_R$ with 1100° C.≤$T_R$≤1550° C. and optionally held at this temperature. Temperatures <1100° C. or >1550° C. result in worsened powder properties, or in a less cost-effective method. The reaction runs for industrial purposes particularly well if temperatures $T_R$ from approximately 1200° C. to 1450° C. are selected.

While in the lower temperature range according to the invention, very long holding times at $T_R$ are necessary to set an advantageous degree of reduction of 90%, in the upper temperature range according to the invention, the holding time can be selected as very short or can be omitted entirely. The degree of reduction R is defined as the ratio of the material quantity of oxygen degraded in the chromium oxide or chromium hydroxide up to the moment t, in relation to the total existing oxygen quantity in the non-reduced chromium compound:

$$\%\ red=(Mred,O/Ma,O)\times 100$$

% red degree of reduction in %

Mred,O Mass [g] O in the reduced powder

Ma,O Mass [g] O in the powder batch (before the reduction)

Based on the examples, a person skilled in the art can determine in a simple manner the optimum combination of temperature and time for his furnace (continuous furnace, batch furnace, maximum achievable furnace temperature, The reaction is preferably held essentially constant (isothermal) at $T_R$ over at least 30%, particularly preferably at least 50% of the reaction time.

The presence of hydrocarbon ensures that powder having the properties according to the invention is formed via a chemical transport process. The total pressure of the reaction is advantageously 0.95 to 2 bar. Pressures greater than 2 bar have a disadvantageous effect on the cost-effectiveness of the method. Pressures less than 0.95 bar have a disadvantageous effect on the resulting hydrocarbon partial pressure, which in turn has a very unfavourable effect on the transport processes via the gas phase, which are of great significance for setting the powder properties according to the invention (for example, hardness, green strength, specific surface area). In addition, pressures less than 0.95 bar have a disadvantageous effect on the process costs.

The examples disclose how the hydrocarbon partial pressure can be set in a simple manner. The hydrocarbon is advantageously provided as $CH_4$. Preferably, at least during the heating operation, the hydrocarbon partial pressure is at least temporarily 5 to 500 mbar. A hydrocarbon partial pressure <5 mbar has an unfavourable effect on the powder properties, in particular the green strength. A hydrocarbon partial pressure >500 mbar results in a high carbon content in the reduced powder. The residual gas atmosphere is preferably hydrogen in this case. The action of hydrogen and hydrocarbon preferably occurs at least in the temperature range of 800° C. to 1050° C. In this temperature range, the hydrocarbon partial pressure is preferably 5 to 500 mbar. The reaction mixture forming from the starting materials is preferably located in this case for at least 45 minutes, particularly preferably for at least 60 minutes, in this temperature range. This time includes both the heating operation and also any possible isothermal holding phases in this temperature range. It is ensured by the method conditions according to the invention that at temperatures preferably $<T_R$, at least one compound selected from the group consisting of chromium oxide and chromium hydroxide is at least partially reacted to form chromium carbide under the action of hydrogen and hydrocarbon. Preferred chromium carbides are $Cr_3C_2$, $Cr_7C_3$, and $Cr_{23}C_6$. The partial formation of chromium carbide resulting via the hydrocarbon partial pressure in turn has a favourable effect on the powder properties. Furthermore, it is ensured by the method conditions according to the invention that the chromium carbide reacts with the chromium oxide/chromium hydroxide, which is present in the reaction mixture and/or admixed, to form chromium, wherein this process dominates at $T_R$.

The hydrocarbon can be added to the reaction in gaseous form, preferably without admixing a solid carbon source. In this case, the at least one compound from the group consisting of chromium oxide and chromium hydroxide is preferably reduced under at least temporary action of a $H_2$—$CH_4$ gas mixture. A $H_2/CH_4$ volume ratio in the range 1 to 200, particularly advantageously 1.5 to 20, is advantageously selected. The action of the $H_2$—$CH_4$ gas mixture occurs in this case preferably at least temporarily during the heating phase to $T_R$, wherein the influence on the formation of the powder form is very favourable in particular in the temperature range of 850 to 1000° C. If a temperature of approximately 1200° C. is reached, the process is preferably switched over to a pure hydrogen atmosphere, preferably having a dew point of <−40° C. (measured in the region of the gas supply). If $T_R$ is less than 1200° C., the changeover to pure hydrogen atmosphere preferably occurs upon reaching $T_R$. The isothermal phase at $T_R$ and cooling to room temperature advantageously occur in a hydrogen atmosphere. In particular during the cooling, it is advantageous to use hydrogen having a dew point <−40° C., to avoid back-oxidation.

In one embodiment, a solid carbon source is admixed to the chromium oxide and/or chromium hydroxide. Preferably, between 0.75 and 1.25 mol, preferably between 0.90 and 1.05 mol of carbon is used in this case per mol of oxygen in the chromium compound. In this case, this means the quantity of carbon available for the reaction with the chromium compound. In a particularly preferred embodiment variant, the ratio of oxygen to carbon is slightly substoichiometric at approximately 0.98. It is preferably provided that the solid carbon source is selected from the group carbon black, activated carbon, graphite, carbon-releasing compounds, or mixtures thereof. Chromium carbides, for example, $Cr_3C_2$, $Cr_7C_3$, and $Cr_{23}C_6$ can be mentioned as examples of carbon-releasing compounds. The powder mixture is heated to $T_R$ in a $H_2$-containing atmosphere. The $H_2$ pressure is preferably set in this case so that at least in the temperature range of 800° C. to 1050° C., a $CH_4$ partial pressure of 5 to 500 mbar results. The isothermal phase at $T_R$ and cooling to room temperature again advantageously occur in a hydrogen atmosphere. During these process phases, the presence of hydrocarbon is not necessary. Hydrogen prevents back-oxidation processes during this process phase and during the cooling phase. During the cooling phase, a hydrogen atmosphere having a dew point <−40° C. is preferably used.

BRIEF DESCRIPTION OF THE SEVERAL VIEWS OF THE DRAWING

Further advantages and details of the invention are explained hereafter on the basis of examples and figures.

DESCRIPTION OF THE INVENTION

Example 1

Figure 1:
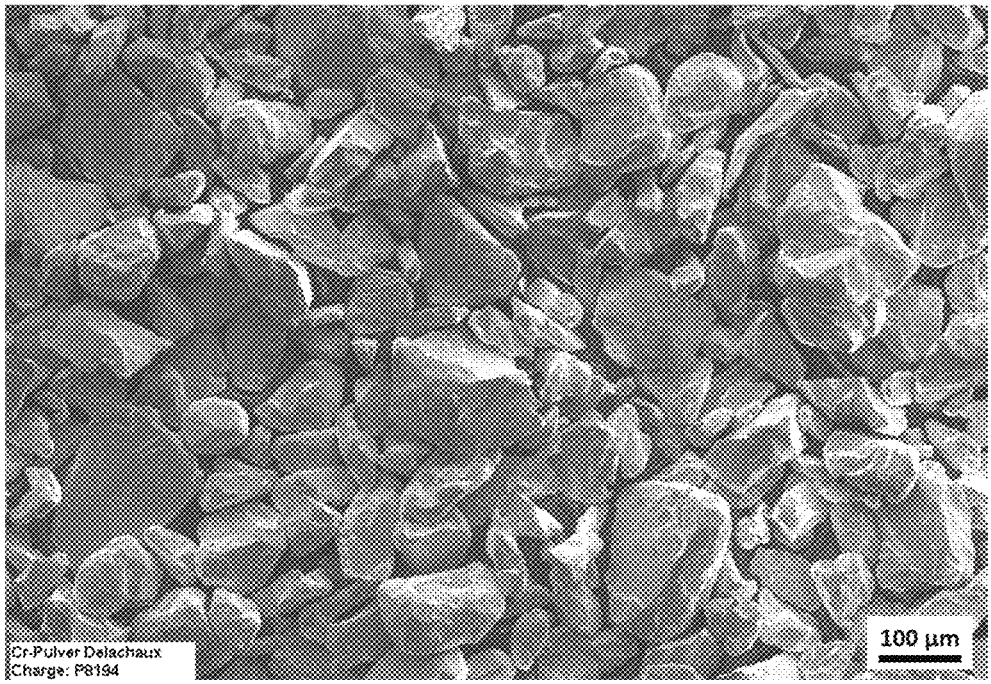
FIG. 1 shows a picture of the powder morphology of chromium metal powder produced from chromium oxides by aluminothermic method
Figure 2:
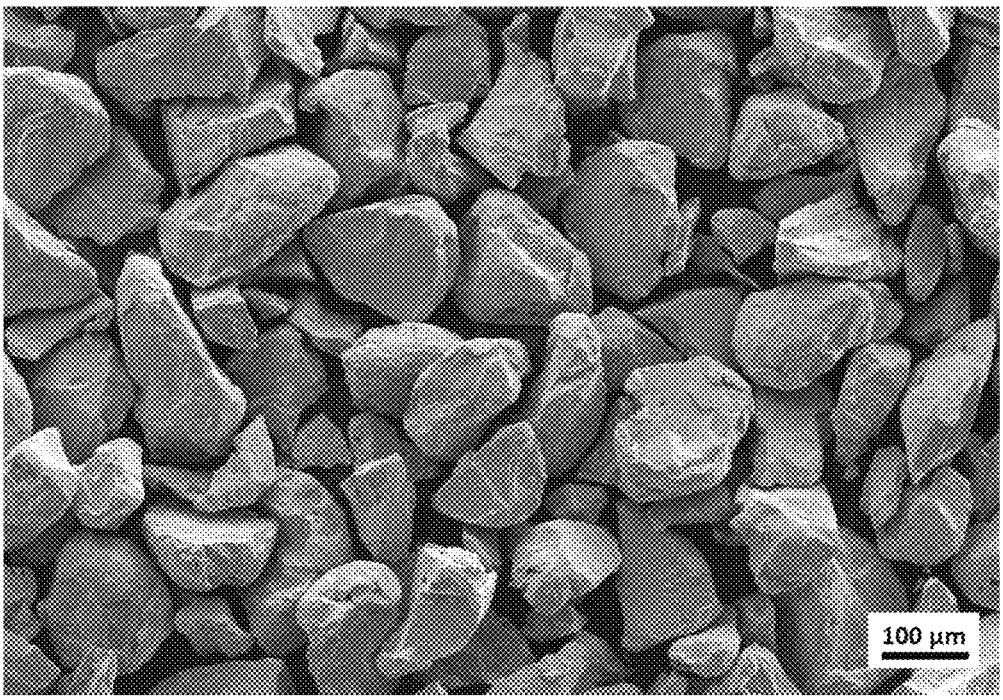
FIG. 2 shows a picture of the powder morphology of chromium metal powder produced from chromium oxides by an electrolytic method
Figure 3:
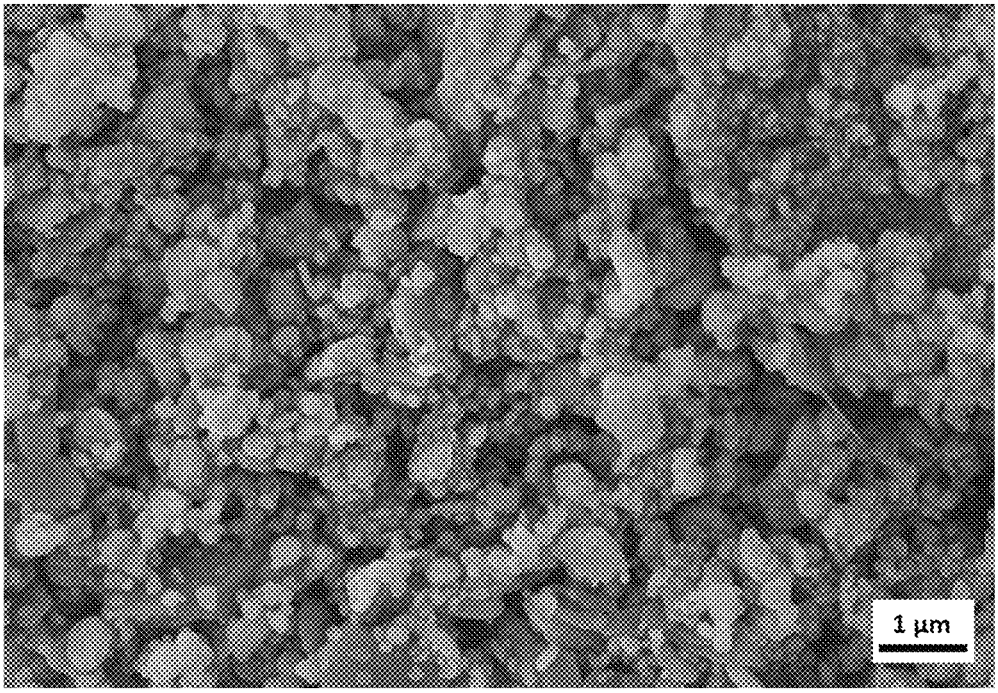
FIG. 3 shows an SEM picture of $Cr_2O_3$ (pigment quality).
Figure 4:
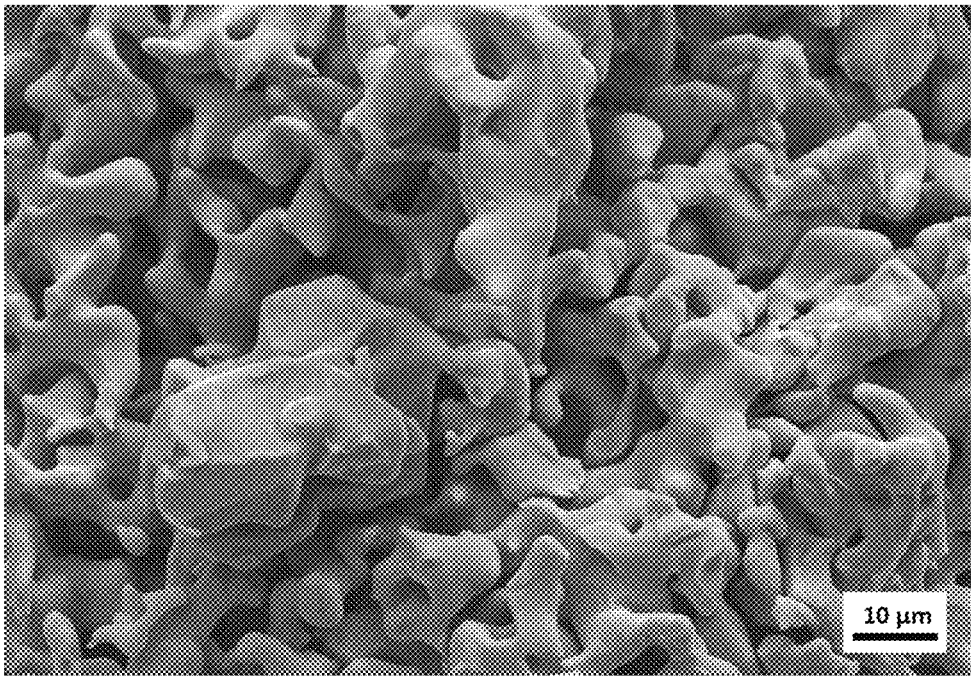
FIGS. 4; 5*a,b* show SEM pictures of metal powders obtainable according to the method according to the invention.

500 g $Cr_2O_3$ in pigment quality (Lanxess Bayoxide CGN-R) having a mean particle size $d_{50}$ of 0.9 μm measured by means of laser diffraction (powder morphology see FIG. 3) was heated in $H_2$ (75 vol. %)-$CH_4$ (25 vol. %) (flow rate 150 l/h, pressure approximately 1 bar) in 80 min. to 800° C. In the further procedure, the reaction mixture was slowly heated to 1200° C., wherein the reaction mixture was in the temperature range from 800 to 1200° C. for 325 minutes. The reaction mixture was then heated in 20 minutes to $T_R$ with $T_R$=1400° C. The holding time at 1400° C. was 180 min. Heating from 1200° C. to $T_R$ and holding at $T_R$ were performed with supply of dry hydrogen with a dew point <−40° C., wherein the pressure was approximately 1 bar. The furnace cooling was also performed under $H_2$ with a dew point <−40° C. A metallic sponge was obtained, which could be deagglomerated very easily to form a powder. The chromium metal powder thus produced is shown in FIG. 4. The degree of reduction was >99.0%, the carbon content was 80 μg/g, and the oxygen content was 1020 μg/g. An x-ray diffraction analysis only delivered peaks for body centred cubic (BCC) chromium metal. The specific surface area was determined by means of the BET method (according to ISO 9277:1995, measurement range: 0.01-300 $m^2/g$; device: Gemini II 2370, heating temperature: 130° C., heating time: 2 hours; adsorptive: nitrogen, volumetric analysis via five-point determination) and was 0.14 $m^2/g$, the bulk density was 1.2 $g/cm^3$. The nanohardness $_{HIT\ 0.005/5/1/5}$ was determined according to EN ISO 14577-1 and was 3

GPa. The green strength was determined according to ASTM B 312-09. As a compression additive, 0.6 Ma % LICOWAX® Micropowder PM (supplier Clariant, product number 107075, CAS—No. 00110-30-5) was used. At a compression pressure of 550 MPa, the green strength was 23.8 MPa, at 450 MPa 18.1 MPa, at 300 MPa 8.5 MPa, at 250 MPa 7.2 MPa, and at 150 MPa 3.0 MPa.

Example 2

Figure 5A:
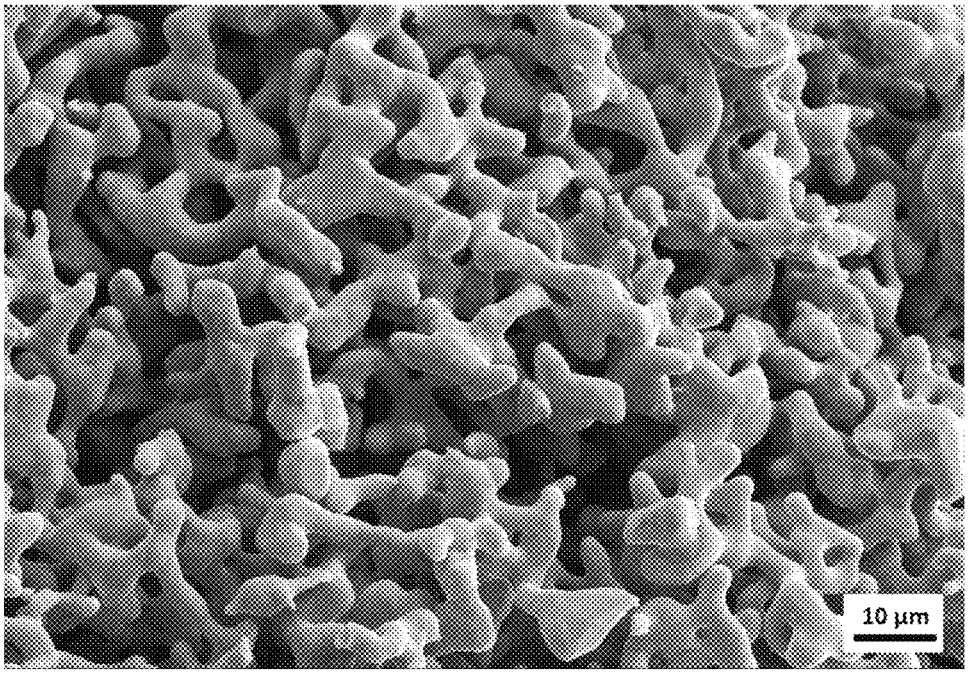
Figure 5B:
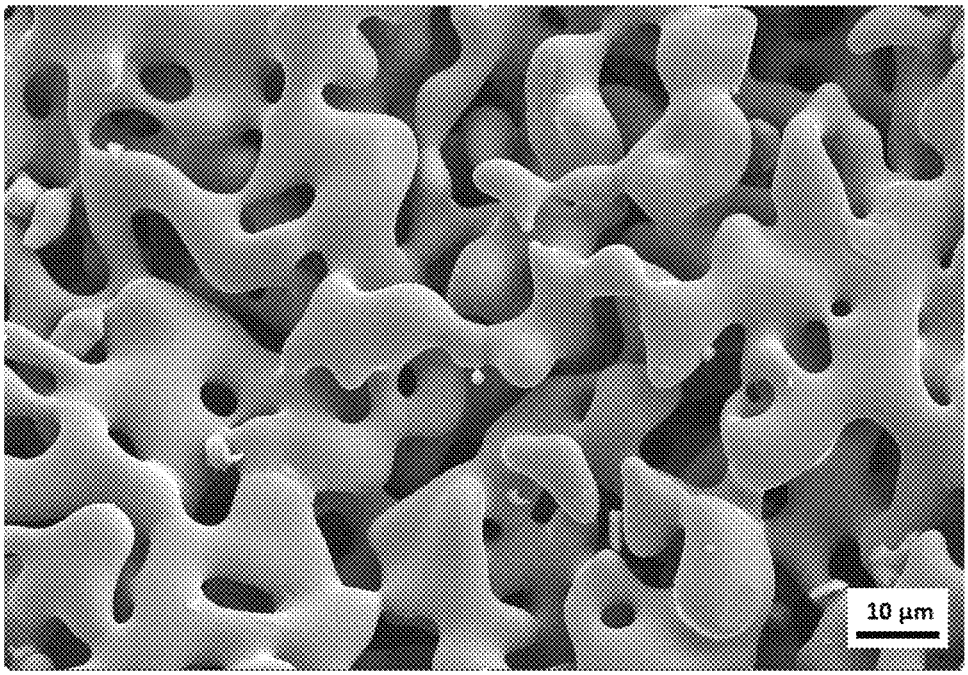
Figure 6:
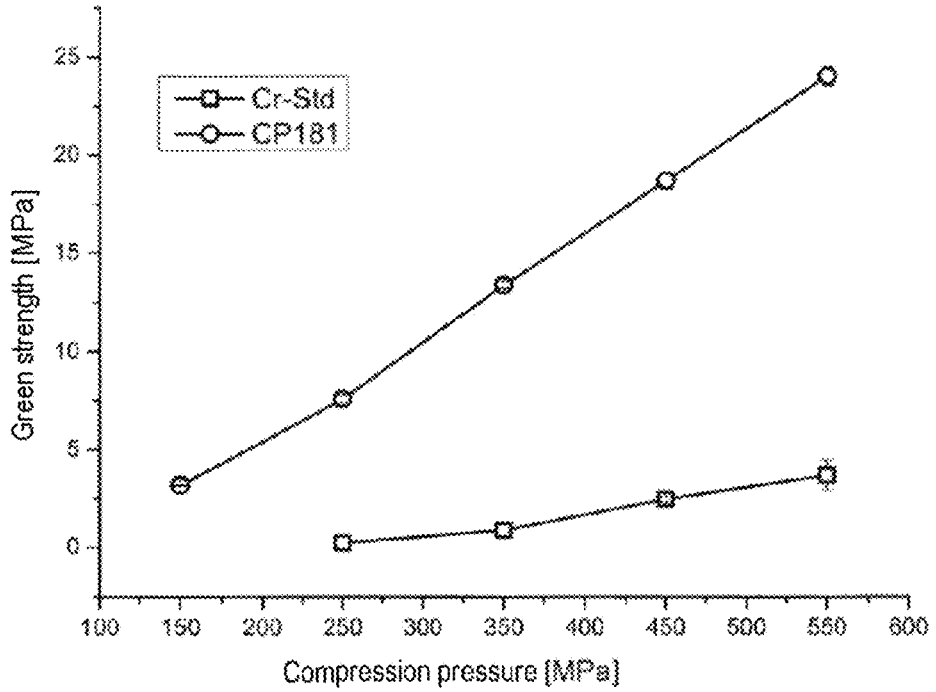
FIG. 6 shows the green strength of powder according to the invention (CP—181) in comparison to aluminothermically produced chromium powder (Cr—standard).

$Cr_2O_3$ in pigment quality (Lanxess Bayoxide CGN-R) having a mean particle size $d_{50}$ of 0.9 μm measured by means of laser diffraction was well mixed with amorphous carbon black (Thermax ultra-pure N908—Cancarb). The carbon content of the mixture thus produced was 0.99 mol/mol oxygen in $Cr_2O_3$. 12500 g of this mixture was heated in 80 minutes to 800° C. and then in 125 minutes to 1050° C. The heating was performed under the action of $H_2$, wherein the $H_2$ pressure was set so that in the temperature range of 800° C. to 1050° C., the $CH_4$ partial pressure measured by mass spectrometry was >15 mbar. The total pressure was 1.1 bar in this case. The reaction mixture was then heated in 20 min. to $T_R$ with $T_R$=1200° C. The holding time at 1200° C. was 540 min. Heating from 1000° C. to $T_R$ and holding at $T_R$ were performed with supply of dry hydrogen with a dew point <−40° C., wherein the pressure was approximately 1 bar. The furnace cooling was also performed under $H_2$ with a dew point <−40° C. A metallic sponge was obtained, which could be deagglomerated very easily to form a powder. The chromium metal powder thus produced is shown in FIGS. 5*a, b*. The carbon content and oxygen content are shown in Table 1. The x-ray diffraction analysis only delivered peaks for body centred cubic (BCC) chromium metal. The green strength was determined according to ASTM B 312-09. As a compression additive, 0.6 Ma % LICOWAX® Micropowder PM (supplier Clariant, product number 107075, CAS—No. 00110-30-5) was used. In this case, 550 MPa, 450 MPa, 350 MPa, 250 MPa, and 150 MPa were applied as compression pressures. FIG. 6 shows the measured green strength values in comparison to samples which were compressed using aluminothermically produced powder (Cr-standard). The powder according to the invention (CP181) displayed a green strength at least five times higher in this case.

Figure 7:
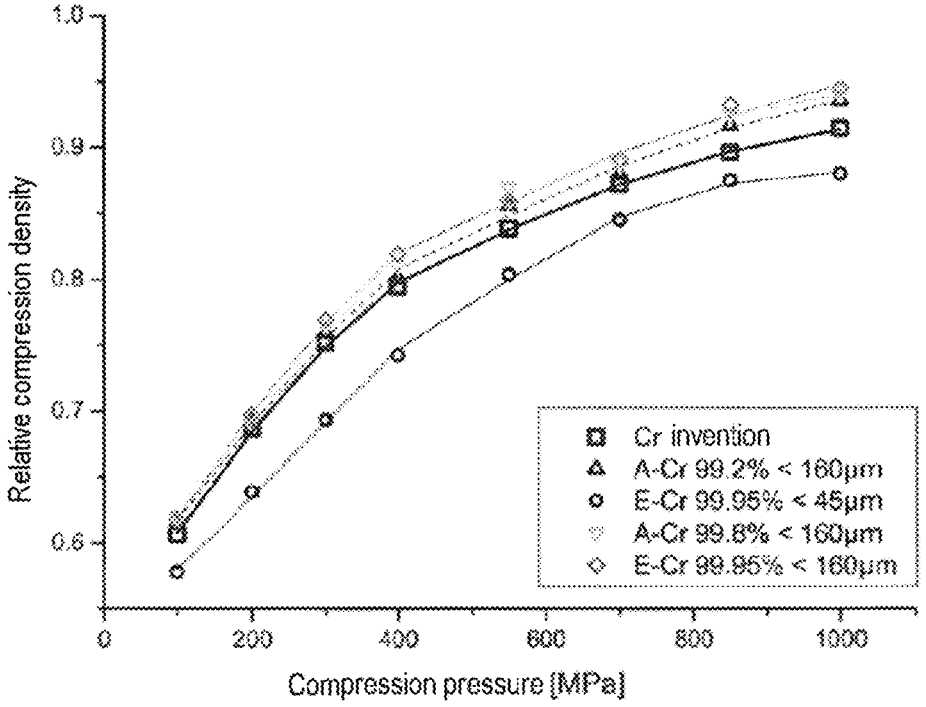
FIG. 7 shows the relative compression density of powder according to the invention in comparison to aluminothermically (A-Cr) and electrolytically (E-Cr) produced chromium of differing purity (specification in % by weight) and powder particle size.

The powder batch (with 0.6 Ma % LICOWAX® Micropowder PM compression additive) was furthermore compressed at various pressures to form pill-shaped samples. In FIG. 7, the relative compression densities are shown as a function of the compression pressure in comparison to standard chromium metal powder (E-Cr: electrolytically produced; A-Cr: aluminothermically produced) with different particle sizes.

Furthermore, the specific surface area was determined according to BET (ISO 9277:1995, measurement range: 0.01-300 $m^2/g$; device: Gemini II 2370, heating temperature: 130° C., heating time: 2 hours; adsorptive: nitrogen, volumetric analysis via five-point determination) and the nanohardness $_{HIT\ 0.005/5/1/5}$ was determined according to EN ISO 14577-1. These features are listed in Table 1 and compared to the properties of chromium powder produced electrolytically. The significantly lower nanohardness of the powder according to the invention is noteworthy. The particle size calculated from the BET surface area was 8.3 μm.

TABLE 1

Properties of chromium powder according to the invention in comparison to electrolytically produced chromium powder

| powder type | BET surface area [$m^2/g$] | O [μg/g] | C [μg/g] | Nanohardness [GPa] |
|---|---|---|---|---|
| Chromium powder according to the invention (example 2) | 0.10 | 1064 | 114 | 2.92 |
| Electrolytically produced chromium powder, particle size <45 μm | 0.11 | 736 | 87 | 5.32 |

Example 3

Figure 8:
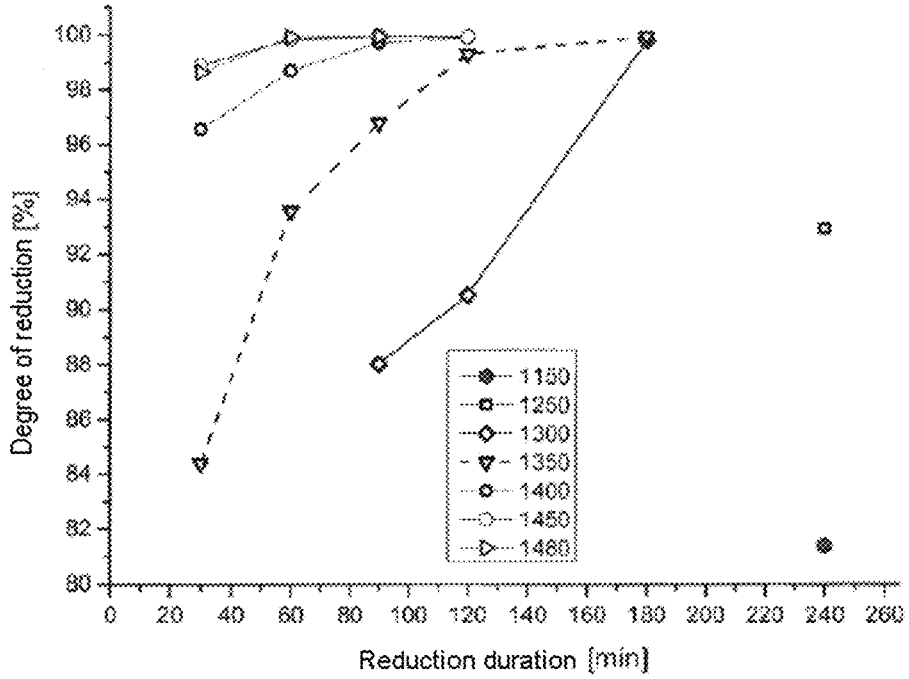
FIG. 8 shows the time curve of the reduction of $Cr_2O_3$ to chromium at different temperatures according to the invention.
Figure 9:
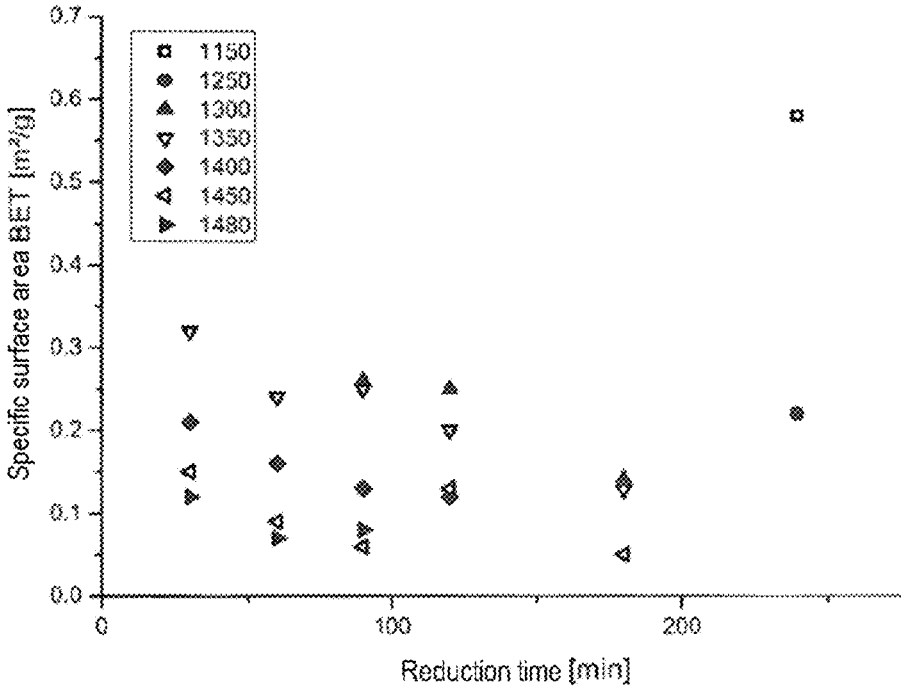
FIG. 9 shows the specific surface area of various chromium powders according to the invention.

In each case 20 g of a mixture according to example 2 was heated in a molybdenum crucible in 80 min. to 800° C. and then in 125 min. to 1050° C. The heating was performed under the action of $H_2$, wherein the $H_2$ was set so that in the temperature range of 800° C. to 1050° C., the $CH_4$ partial pressure measured by mass spectrometry was >15 mbar. The total pressure was 1.1 bar in this case. The reaction mixture was then heated at a heating speed of 10 K/min to $T_R$. In this case, 1150° C., 1250° C., 1300° C., 1350° C., 1400° C., 1450° C., and 1480° C. were applied as $T_R$. The holding times at $T_R$ were 30 min, 60 min, 90 min, 120 min, and 180 min. Heating from 1000° C. to $T_R$ and holding at $T_R$ were performed with supply of dry hydrogen with a dew point <−40° C., wherein the pressure was approximately 1 bar. The furnace cooling was also performed under $H_2$ with a dew point <−40° C. The degree of reduction was determined as described in the description. As is apparent from FIG. 8, an advantageous degree of reduction of >95% at 1400° C., 1450° C., and 1480° C. was already significantly exceeded at a holding time of 30 minutes. At 1350° C. it required approximately 80 min. for this purpose, at 1300° C. approximately 160 min. At 1250° C. and 1150° C. it required approximately 260 minutes and 350 minutes, respectively, for this purpose (extrapolated values). SEM studies showed that the powders thus produced have a sponge-like morphology in conjunction with a very high BET surface area (see FIG. 9).

The invention claimed is:

1. A metal powder, comprising:

a chromium content of at least 90 Ma %; and a nanohardness $_{HIT\ 0.005/5/1/5}$ according to EN ISO 14577-1 of ≤4 GPa.

2. The metal powder according to claim 1, wherein the metal powder is chromium powder having a metallic purity ≥99.0 Ma %.

3. The metal powder according to claim 1, wherein the metal powder is an alloyed powder or composite powder.

4. The metal powder according to claim 1, wherein the metal powder is granulated.

5. The metal powder according to claim 1, which further comprises a surface area according to BET of ≥0.05 m2/g with or without a surface-enlarging operation.

6. A method for producing a metal powder, the method comprising the following steps:

reducing at least one compound of the group consisting of chromium oxide and chromium hydroxide, optionally with an admixed solid carbon source, under at least temporary action of hydrogen and hydrocarbon to produce a metal powder having:

a chromium content of at least 90 Ma %; and a nanohardness $_{HIT\ 0.005/5/1/5}$ according to EN ISO 14577-1 of ≤4 GPa.

7. The method according to claim 6, which further comprises:

heating the compound of the group consisting of chromium oxide and chromium hydroxide, optionally with an admixed solid carbon source, to a temperature TR with 1100° C.≤TR≤1550° C.;

optionally holding the temperature at 1100° C.≤TR≤1550° C.; and at least temporarily setting the hydrocarbon partial pressure at 5 to 500 mbar at least during the heating step.

8. The method according to claim 6, wherein the action of hydrogen and hydrocarbon occurs at least in a temperature range of 800 to 1050° C.

9. The method according to claim 8, which further comprises setting the hydrocarbon partial pressure at 5 to 500 mbar at least in the temperature range of 800 to 1050° C.

10. The method according to claim 8, which further comprises setting a sum of heating time and holding time in the temperature range of 800° C. to 1050° C. to be at least 45 minutes.

11. The method according to claim 6, which further comprises setting a total pressure at 0.95 to 2 bar.

12. The method according to claim 6, which further comprises reducing the compound of the group consisting of chromium oxide and chromium hydroxide under at least temporary action of a $H_2$—$CH_4$ gas mixture.

13. The method according to claim 12, which further comprises setting a $H_2/CH_4$ volume ratio at 1 to 200 or 1.5 to 20.

14. The method according to claim 6, which further comprises admixing a solid carbon source having at least one component selected from the group consisting of carbon black, activated carbon, graphite, carbon-releasing compound and mixtures thereof.

15. The method according to claim 14, which further comprises using between 0.75 and 1.25 mol or between 0.90 and 1.05 mol of carbon per mol of oxygen in the chromium oxide or chromium hydroxide.

16. The method according to claim 6, which further comprises at least partially reacting at least one compound selected from the group consisting of chromium oxide and chromium hydroxide under the action of hydrogen and hydrocarbon to form a chromium carbide selected from the group consisting of $Cr_3C_2$, $Cr_7C_3$ and $Cr_{23}C_6$.

17. The method according to claim 16, which further comprises at least partially reacting the chromium carbide with at least one compound selected from the group consisting of chromium oxide and chromium hydroxide to form chromium.

18. The method according to claim 6, wherein the hydrocarbon is $CH_4$.

* * * * *